United States Patent [19]

Comerford

[11] Patent Number: 4,891,481

[45] Date of Patent: Jan. 2, 1990

[54] SWITCH CONTACT BLADE

[75] Inventor: John Comerford, Glendale Heights, Ill.

[73] Assignee: Eaton Corporation, Cleveland, Ohio

[21] Appl. No.: 205,879

[22] Filed: Jun. 13, 1988

[51] Int. Cl.[4] ..... H01H 5/30; H01H 5/18

[52] U.S. Cl. ..... 200/409; 200/405; 200/452; 200/459; 200/461

[58] Field of Search ..... 200/402, 405, 408, 409, 200/453, 454, 461, 454, 520, 452, 456

[56] References Cited

U.S. PATENT DOCUMENTS

| | | | |
|---|---|---|---|
| 2,571,453 | 10/1951 | Jackson | 200/409 |
| 2,589,563 | 3/1952 | Miller | 200/461 |
| 3,098,903 | 7/1963 | Anderson | 200/461 |
| 3,359,389 | 12/1967 | Landin | 200/408 |
| 4,644,115 | 2/1987 | Nishimori et al. | 200/409 |

*Primary Examiner*—Henry J. Recla
*Assistant Examiner*—Glenn T. Barrett
*Attorney, Agent, or Firm*—A. E. Chrow

[57] ABSTRACT

An electrical snap-action type switch contact blade (80) is provided. Blade (80) has a base (6) and an electrical contact region (10) intermediate a pair of spaced-apart support legs (14) that extend angularly away from base (6) to respective free-ends. A tongue (12) extends arcuately away from region (10) in a direction opposite to support legs (14) and towards base (6) to a free-end (23). Free-end (23) of tongue (12) and the free-ends of support legs (14) respectively engage spaced-apart anchoring sites to secure blade (80) to the switch frame. Blade (80) can be actuated by application and removal of a Force (F) both against base (6) and for a prescribed distance (X) along support legs (14).

6 Claims, 2 Drawing Sheets

SWITCH CONTACT BLADE

INTRODUCTION

This invention relates generally to a snap-action switch contact blade and more particularly to a snap-action switch contact blade that is releasably resiliently secured to the switch and operative to move an electrical contact from a first position to a second position upon application of an activating force thereagainst and to resiliently return the contact to the first position upon removing the activating force therefrom.

BACKGROUND

Snap-action contact blades have been used for many years in electrical switches to open or close electrical circuits by depressing a button or turning a knob or moving a lever or the like to apply an actuating force against the blade and that automatically returns the circuit to its original condition upon returning the button, knob, lever, or other means to its original position and thereby removing the force from the blade.

Such prior art type contact blades have characteristically featured a thin resilient plate having the electrical contact secured to one end and having an elongate opening having either one or two curved tongues extending thereinto that are adapted to engage some type of anchor on the switch which, in conjunction with means for securing the opposite end of the plate, provides a resilient cantilevered mounting for the plate.

Examples of plate-like contact blades having a singular tongue are respectively disclosed in U.S. Pat. Nos. 3,967,369 and 4,644,115, the disclosures of which are incorporated herein by reference.

Examples of plate-like contact blades having two opposed tongues are respectively disclosed in U.S. Pat. Nos. 3,532,840; 3,449,534; and 3,944,768, the disclosures of which are incorporated herein by reference.

An example of a plate-like contact blade having a central portion intermediate a pair of curved tongues is disclosed in U.S. Pat. No. 3,989,914, the disclosure of which is incorporated herein by reference and an example of a plate-like contact blade similar to the former but having two pairs of opposed tongues is disclosed in U.S. Pat. No. 4,499,346, the disclosure of which is incorporated herein by reference.

All of the above contact blades, however, require the primary plate member be secured to the switch in some manner either at or near the center or at or near the end opposite to that at which the electrical contact is located.

The contact blade of the present invention departs from the practice of utilizing a resilient plate with one or more curved tongues that must be secured to the switch either at or near the center or at or near the end opposite to that at which the electrical contact is mounted by providing a resilient curved tongue intermediate a pair of spaced-apart support legs that respectively extend from the same side of the contact blade to greatly enhance compactness and which cooperate with each other to resiliently support the blade on the switch frame and are respectively anchored thereto in a manner providing a broad distance along specified surfaces on the opposite side of the plate upon which the activating force may be applied for activating the switch.

The contact blade of the present invention is not the first to have support legs extending from the main body of the blade, however, for such are utilized in a contact blade manufactured and sold as a "Series 770" switch by the assignee of this invention but which differs substantially from the contact blade of the present invention by having the support legs on the opposite side of the blade from which the tongue extends which substantially lessens its compactness.

SUMMARY OF THE INVENTION

Accordingly, it is an object of this invention to provide a compact snap-action electrical switch contact blade.

It is another object of this invention to provide an electrical switch contact blade that is simple and economical to make and enables simple assembly and disassembly with the switch.

It is still another object of this invention to provide a compact snap-action switch contact blade that enables the actuating force to be applied over a broad length along specified surfaces to provide a broad range of displacement distances able to effect making and breaking of the electrical contact.

It is still another object of the invention to provide a snap-action switch contact blade featuring support legs that in preferred embodiments contribute to resilient snap-back when the actuating force is removed and which in conjunction with a tongue enables resilient releasable securement to the switch enabling simple assembly and disassembly therewith.

It is yet another object of this invention to provide an electrical switch including at least one snap-action contact blade mounted thereon that features support legs and a resilient tongue that complement each other in providing resilient snap-back when the actuating force is removed and are respectively anchored to the switch in a manner enabling the force to be applied thereagainst over a broad length along specified surfaces thereof enabling a plurality of force and blade displacements effective to make and break the electrical contact.

DETAILED DESCRIPTION OF SOME PREFERRED EMBODIMENTS

Figure 1:
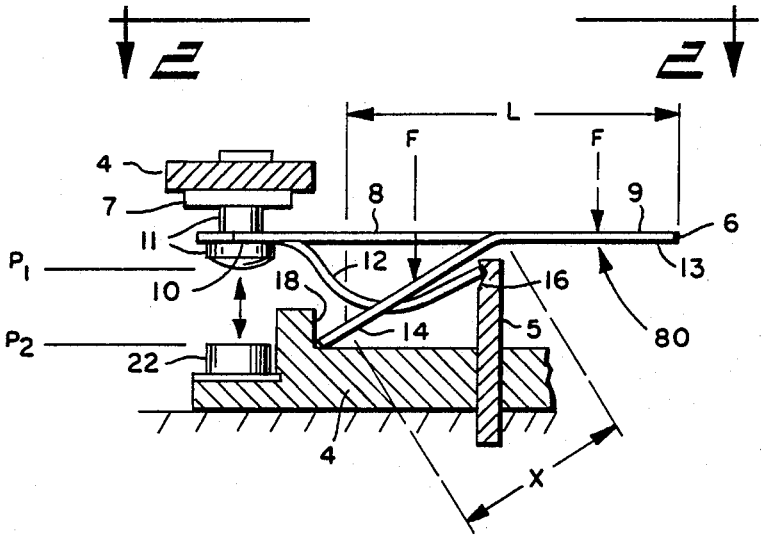
FIG. 1 is a partial cross-sectional side view of an electrical switch 4 utilizing an embodiment 80 of the contact blade of the invention.

In FIG. 1, contact blade 80 is mounted on a switch frame 4 made from a suitable electrically insulative material. Blade 80 is a snap-action contact blade made from a suitably resilient electrically conductive material and is operative to move downwardly in FIG. 1 when an actuating force "F" is applied thereto by means of a plunger, rocker arms or other switch means (not shown) to cause an electrical contact region 10 to move from a first position "$P_1$" to a second position "$P_2$" and to resiliently return contact region 10 to first position "$P_1$" when force "F" is removed. Blade 80 is normally positioned in frame 4 in a pre-loaded condition which may be accomplished by any suitable means such as by providing a lug or the like that extends from frame 4 or by including an upward stroke stop in the button or other device applying a force thereagainst that operates to hold blade 80 downwardly in a predetermined partially compressed condition well known to those skilled in the art which essentially maintains a force thereagainst that is less than the force "F" required to actuate the switch.

When force "F" is not applied against pre-loaded blade 80, contact region 1 is resiliently biased against electrical contact 7 mounted to switch frame 4 shown in FIG. 1. Contact 7 is electrically connected to an electrical circuit (not shown) operated by the switch. Application of force "F" against blade 80 causes contact region 10 to move downwardly in FIG. 1 to position "P2" where it contacts stop 22. Contact region 10 may be any type of region suitable to make electrical contact with contact 7 and is not limited to the button-type contact 11 shown in FIGS. 1 and 2.

The second connection to the electrical circuit being controlled by the switch may be through post 5 where post 5 is made from a suitably electrically conducting material.

Thus blade 80 in the pre-loaded condition operates to open an electrical circuit when force "F" is applied and closes the circuit when force "F" is removed. The opposite, of course, could also occur when the locations of contact 7 and stop 22 are reversed which would then cause contact region 10 to close an electrical circuit when force "F" is applied and to maintain the circuit open when force "F" is removed.

Figure 2:
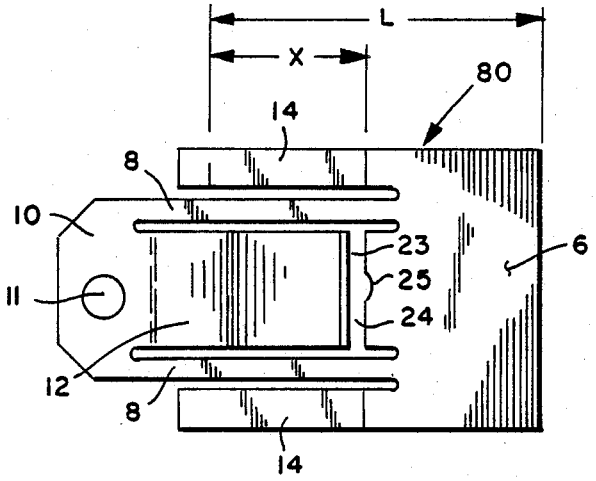
FIG. 2 is a top view of blade 80 of FIG. 1.

As hereinafter described with respect to FIGS. 1 and 2, blade 80 has a base portion 6 from which extends a central portion 8 between base portion 6 and contact region 10. Base portion 6 has a side 9 thereof facing in the direction from which force "F" is applied and is operative to receive force "F"0 thereagainst. Central portion 8 has an opening 24 therethrough and a tongue 12 extends from contact region 10 arcuately downwardly through opening 24 and thence upwardly towards base portion 6 and ends in a free-end 23 that is spaced-apart from base portion 6.

Central portion 8 is intermediate a pair of support legs 14 that extend angularly away from an opposite side 13 of base portion 6 to respective free-ends on the same side of blade 80 from which tongue 12 extends. Frame 4 of the switch is provided with a wall or shoulder 18 and a preferably rectangular or cylindrical post 5 having a notch 16 which is in spaced-apart facing relationship with wall or shoulder 18. Wall 18 provides a first anchoring means for support legs 14 and notch 16 provides a second anchoring means for free-end 23 of tongue 12. Tongue 12 is adapted such that its free-end 23 engages notch 16 and the free-ends of support legs 14 engage wall 18 such that the combination resiliently secures blade 80 to switch frame 4 by either engaging the free-ends of support legs 14 with wall 18 and then snapping free-end 23 of tongue 12 into notch 16 or by engaging free-end 23 with notch 16 and then snapping support legs 14 into position against wall or shoulder 18. The process is easily reversed making both the assembly and disassembly of blade 80 with the switch quite simple. In cases where post 5 of switch frame 4 extends into opening 24 illustrated in FIG. 2, the edge of base portion 6 facing towards opening 24 may be adapted such as by including a curve 25 therein for receiving post 5 therethrough. Thus, support legs 14 and tongue 12 cooperate to resiliently support pre-loaded blade 80 on switch frame 4 and bias contact region 10 against contact 7. It can readily be seen in FIG. 3 that support legs 14 respectively have a section thereof operative to receive actuating force "F" thereagainst for a predetermined distance "X" therealong. By both support legs 14 and tongue 12 extending from the same side of blade 80, a broad distance "L" is provided on the opposite side thereof that includes all of base portion 6 and a predetermined length "X" of support legs 14 against which force "F" can be applied to actuate blade 80. Generally, the magnitude of force "F" required to actuate blade 80 increases and its displacement decreases as its application location moves from right to left within distance "L" as shown in FIG. 1. Such variability of force and displacement distance for force "F" enables a broad force and displacement range for operating the switch. Generally, the location of the end boundary of length "X" closest to the free-ends of support legs 14 is predetermined by the resiliency of legs 14 and the maximum value of force "F" desired to actuate the switch. As can be seen in FIG. 2, the preferability of dividing force "F" into equal parts that are respectively applied concurrently to each support leg 14 increases for increasing distance along legs 14 from base portion 6.

Figure 3:
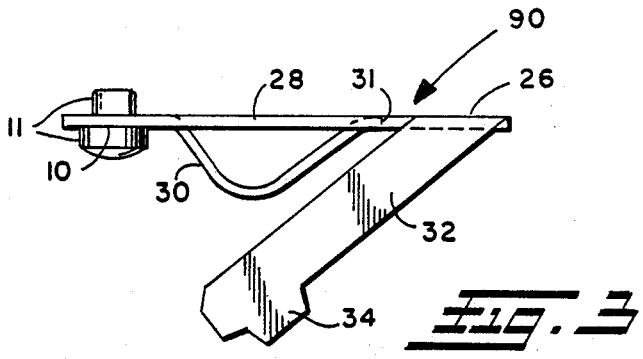
FIG. 3 is a side view of an embodiment 90 of the contact blade of the invention.

In FIG. 3, contact blade 90 of the invention has a base portion 26, a central portion 28 and an electrical contact region 10 that are substantially respectively the same as hereinbefore described with respect to blade 80. Blade 90 differs from blade 80 by having free-end 31 of tongue 30 extending into the opening of central portion 28 as earlier described and by having support legs 32 that are folded from opposite edges of base portion 26 and extend angularly away from base portion 26 on the same side as tongue 30 and are disposed in a plane substantially transverse to base portion 26 and central portion 28. Support legs 32 are each provided with a projection 34 adjacent their respective free-ends that extend away from and are adapted to engage a groove in switch frame 4 which in this case provides the first anchoring means therefor rather than wall 18 of FIG. 1.

Figure 4:
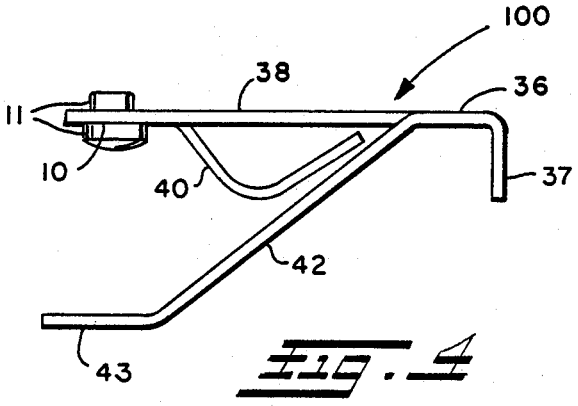
FIG. 4 is a side view of an embodiment 100 of the contact blade of the invention.

In FIG. 4, blade 100 of the invention has a base portion 36, central portion 38, contact region 10 and tongue 40 substantially the same as for blades 80 and 90 but differs therefrom by having a portion 43 adjacent the free-ends of its support legs 42 that are in substantial parallel alignment with base portion 36 and central portion 38 and by having an end portion 37 of base portion 36 bent downwardly as shown in FIG. 4. Portion 37 may, of course, extend in other directions from base portion 36 and may serve to rigidize base portion 36 and/or as an additionally contacting region for operating another circuit and/or provide a stop for blade 100.

Figure 5:
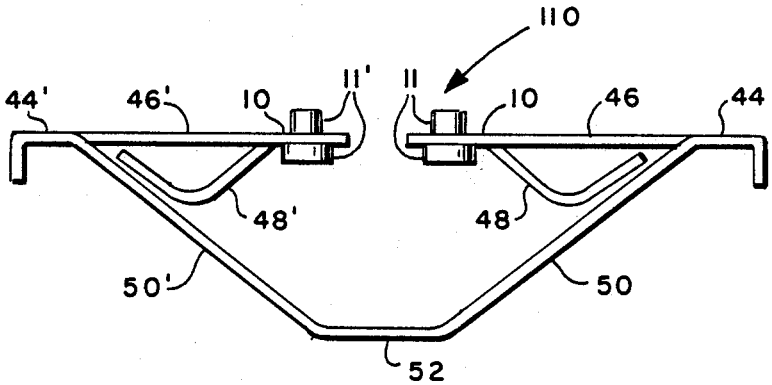
FIG. 5 is a side view of an embodiment 110 of the contact blade of the invention which features a pair of opposed contact blades whose respective support legs have been merged together to provide a union therebetween.

FIG. 5 shows an embodiment wherein contact blade 110 of the invention comprises two opposed blades 100 of FIG. 4 having respective contact regions 10 and 10' in spaced-apart relationship with each other and having corresponding base portions 44 and 44', central portions 46 and 46', tongues 48 and 48', and support legs 50 and 50' the latter of which are merged at their free-ends as referenced by numeral 52 to provide an electrical union therebetween which may be utilized to provide electrical connection to other switch contact blades such as additional pairs of blades 100 in tandem therewith. In such case, separate posts having their respective anchoring means can be employed to secure the free-ends of tongues 50 and 50' and a common anchoring means can be used to engage section 52 and secure it to the switch from on which blade 110 is mounted.

The contact blade of the invention is preferably a one-piece construction made from a suitably resilient electrically conductive material such as spring steel and more preferably a copper or copper alloy well known to those skilled in the art of making switch contact blades.

WHAT IS CLAIMED IS:

1. A snap-action contact blade for mounting on an electrical switch having a frame having spaced-apart first and second anchoring means and effective in a pre-loaded condition to move an electrical contact region thereof from a first position to a second position in response to an actuating force imparted thereagainst and to resiliently return the contact region to the first position upon removal of the actuating force therefrom, said blade comprising:

a base portion having a side thereof adapted to receive the actuating force thereagainst and having a pair of spaced-apart support legs respectively extending angularly away from an opposite side thereof to respective free-ends adapted to releasably engage the first anchoring means;

a central portion extending between the base portion and contact region intermediate the support legs;

an opening through the central portion;

a tongue portion extending arcuately away from the contact region within said opening on the same side of the base portion from which the support legs extend and thence towards the base portion and ending in a free-end that is spaced apart from the base portion and adapted to releasably engage the second anchoring means;

said blade adapted such that when the support leg free-ends engage the first anchoring means and the tongue free-end engages the second anchoring means, the blade is releasably resiliently secured to the switch frame; and said support legs respectively having a section thereof operative to receive the actuating force thereagainst for a predetermined distance from the base portion therealong.

2. An electrical switch having a frame having spaced-apart first and second anchoring means and having a snap-action contact blade effective in a pre-loaded condition to move an electrical contact region thereof from a first position to a second position in response to an actuating force imparted thereagainst and to resiliently return the contact region to the first position upon removal of the actuating force therefrom, said blade comprising:

a base portion having a side thereof adapted to receive the actuating force thereagainst and having a pair of spaced-apart support legs respectively extending angularly away from an opposite side thereof to respective free-ends adapted to releasably engage the first anchoring means;

a central portion extending between the base portion and contact region intermediate the support legs;

an opening through the central portion;

a tongue portion extending arcuately away from the contact region within said opening on the same side of the base portion from which the support legs extend and thence towards the base portion and ending in a free-end that is spaced apart from the base portion and a adapted to releasably engage the second anchoring means;

said blade adapted such that when the support leg free-ends engage the first anchoring means and the tongue free-ends engage the second anchoring means, the blade is releasably resiliently secured to the switch frame; and said support legs respectively having a section thereof operative to receive the actuating force thereagainst for a predetermined distance from the base portion therealong.

3. The blade of claim 1 or 2 wherein the support legs are oriented generally transversely to the base portion, central portion, and tongue portion and an edge thereof provides the section operative to receive the actuating force thereagainst.

4. The blade of claim 3 wherein each support leg includes a projection that extends away therefrom adjacent the free-end thereof and is operative to releasably engage the first anchoring means.

5. The blade of claim 1 or 2 wherein the support legs first extend angularly away from the base portion opposite side and thence are disposed in substantially parallel relationship to the blade base portion and the blade central portion.

6. The contact blade of claim 1 or 2 including a substantially identical second contact blade in opposed relationship thereto, said contact blades having their respective electrical contact regions in spaced-apart relationship to each other and having their respective support legs extending angularly away from their respective base portion opposite sides and towards each other with their respective support leg free-ends merged to provide an electrical union therebetween.

* * * * *